US008191386B2

(12) United States Patent
Howard

(10) Patent No.: US 8,191,386 B2
(45) Date of Patent: Jun. 5, 2012

(54) DISTILLATION METHOD AND APPARATUS

(75) Inventor: Henry Edward Howard, Grand Island, NY (US)

(73) Assignee: Praxair Technology, Inc., Danbury, CT (US)

( * ) Notice: Subject to any disclaimer, the term of this patent is extended or adjusted under 35 U.S.C. 154(b) by 1148 days.

(21) Appl. No.: 12/031,097

(22) Filed: Feb. 14, 2008

(65) Prior Publication Data

US 2009/0205368 A1 Aug. 20, 2009

(51) Int. Cl.
*F25J 3/04* (2006.01)

(52) U.S. Cl. ..... 62/646

(58) Field of Classification Search ..... 62/640, 62/644, 646
See application file for complete search history.

(56) References Cited

U.S. PATENT DOCUMENTS

| | | | | |
|---|---|---|---|---|
| 2,997,854 | A | 8/1961 | Schilling et al. | |
| 3,094,402 | A | 6/1963 | Armstrong et al. | |
| 3,355,901 | A | 12/1967 | Angerhofer | |
| 4,452,621 | A | 6/1984 | Fowles et al. | |
| 4,582,519 | A | 4/1986 | Someya et al. | |
| 5,108,476 | A | 4/1992 | Dray et al. | |
| 5,267,449 | A | 12/1993 | Kiczek et al. | |
| 5,386,692 | A * | 2/1995 | Laforce | 62/646 |
| 5,419,136 | A * | 5/1995 | McKeigue | 62/645 |
| 5,467,601 | A | 11/1995 | Paolino et al. | |
| 5,690,786 | A * | 11/1997 | Cirucci et al. | 162/6 |
| 6,000,239 | A | 12/1999 | Bonaquist et al. | |
| 6,125,656 | A * | 10/2000 | Arman et al. | 62/647 |
| 6,415,628 | B1 | 7/2002 | Ahmed et al. | |
| 6,601,407 | B1 * | 8/2003 | Deniz et al. | 62/646 |
| 6,604,367 | B2 | 8/2003 | Ahmed et al. | |
| 6,622,520 | B1 * | 9/2003 | Prosser et al. | 62/646 |
| 2007/0017251 | A1 * | 1/2007 | Bot et al. | 62/646 |
| 2007/0101762 | A1 * | 5/2007 | Schaub et al. | 62/617 |
| 2009/0100864 | A1 * | 4/2009 | Den Held et al. | 62/643 |

FOREIGN PATENT DOCUMENTS

GB 1 215 377 12/1970

OTHER PUBLICATIONS

"System Practices for Ammonia Refrigerant", Ashrae Refrigeration Handbook, 1998, pp. 3.2-3.5.

* cited by examiner

*Primary Examiner* — Frantz Jules
*Assistant Examiner* — Webeshet Mengesha
(74) *Attorney, Agent, or Firm* — David M. Rosenblum

(57) ABSTRACT

A distillation apparatus and method in which first and second compressed streams are formed from a compressed feed stream, for example, compressed air. The first compressed stream is fully cooled within a main heat exchanger so that it is substantially condensed. The second compressed stream is partly cooled within the main heat exchanger and then introduced into a turboexpander at a temperature such that the turboexpander exhaust stream is superheated. Part of the first compressed stream is mixed with the exhaust stream to produce a combined stream that is no more than 10° C. above saturation temperature at the pressure of the exhaust stream. The combined stream is introduced into a distillation column unit to produce one or more products that are enriched in components of the feed to be separated. In such manner the turboexpansion can occur at a higher temperature and with increased refrigerating effect.

8 Claims, 1 Drawing Sheet

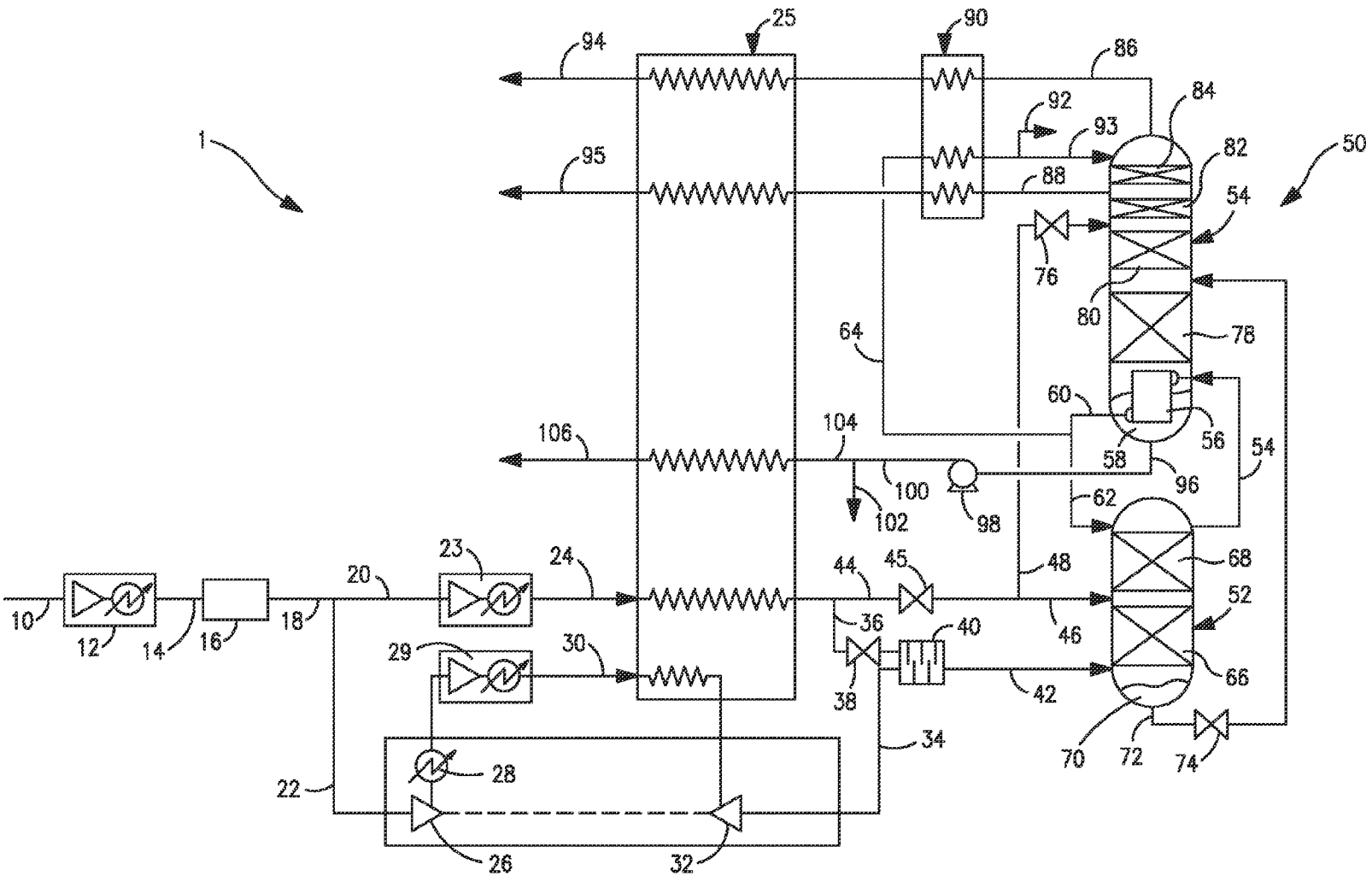
50
54
82
84
78
56
54
68
52
66
74
96
86
93
80
58
62
72
70
92
88
76
60
48
46
42
90
98
40
100
45
34
102
64
104
44
36
38
25
32
94
95
106
24
30
23
28
26
29
20
22
18
16
14
12
10
1

DISTILLATION METHOD AND APPARATUS

FIELD OF THE INVENTION

The present invention relates to a distillation method and apparatus in which part of a compressed feed stream containing components to be separated in a cryogenic distillation process is discharged from a main heat exchanger and then expanded to produce an exhaust stream in a superheated state and another portion of the compressed feed stream is fully cooled within the main heat exchanger and mixed in part with the exhaust stream to remove the superheating imparted to the exhaust stream.

BACKGROUND OF THE INVENTION

Light gas distillation processes are often characterized by the need to separate one or more components of a feed stream at elevated pressure. After substantial cooling and/or expansion, components contained within the feed stream can be separated within one or more distillation columns at cryogenic temperatures. Cryogenic air rectification and nitrogen rejection from natural gas are examples of such light gas distillation processes.

In a distillation process that is used in connection with the cryogenic rectification of oxygen and nitrogen containing streams, nitrogen is separated from oxygen. Where the feed stream is air, other components of air, such as argon, can also be separated. In such a process, a feed stream is compressed and then purified of higher boiling contaminants such as carbon dioxide, moisture and hydrocarbons. The resulting compressed and purified feed stream can be cooled within a main heat exchanger to a temperature suitable for its rectification and then introduced into a distillation column unit having a higher pressure column and a lower pressure column. The higher pressure column is thermally linked to the lower pressure column by a condenser-reboiler that can be in the base of the lower pressure column.

The feed is distilled within the higher pressure column to produce a nitrogen-rich vapor overhead and a crude-liquid oxygen bottoms. The nitrogen-rich vapor overhead can be condensed within the condenser-reboiler against boiling an oxygen-rich liquid that is collected in the base of the lower pressure column. The resulting nitrogen-rich liquid is used to reflux both the higher pressure column and the lower pressure column. The crude-liquid oxygen bottoms is introduced into the lower pressure column for further refinement. Oxygen and nitrogen product streams composed of a second nitrogen-rich vapor overhead and further oxygen-enriched liquid bottoms are extracted and can be introduced into the main heat exchanger and fully warmed in order to cool the incoming feed.

Distillation methods and apparatus can have other uses, for instance, in a nitrogen reject unit that is used for the separation and recovery of nitrogen from a hydrocarbon containing gas stream that can enter the distillation apparatus at pressure from a pipeline. Such a stream contains nitrogen that can be separated and returned for use in enhanced oil recovery projects. Commonly, an integrated dual distillation column arrangement is also used in which the higher pressure column is used to separate nitrogen from methane contained within the feed. A lower pressure column produces the nitrogen product.

In most cryogenic rectification systems, refrigeration must be supplied in order to offset ambient heat leakage, to facilitate heat exchanger operation and to produce liquefied products. In cryogenic air distillation feed air is compressed in a main air compressor and then purified. In instances where a product fraction is desired at substantial pressure, part of the feed air may be fully cooled, liquefied and a portion of which may be introduced into the higher pressure column. In instances where a substantial fraction of the air is desired as liquefied product, a second portion of the feed stream is introduced into a turboexpander to produce an exhaust stream that is also introduced into the higher pressure column. The part of the stream to be expanded can be further compressed within a booster compressor before being introduced into the turboexpander.

There often exists the need to recover liquid products from a cryogenic plant. The amount of liquid recovery is dependent upon the amount of refrigeration imparted to the plant. The turboexpander supplies such refrigeration. However, such turboexpanders represent a significant cost in equipment capital. As such, motivation exists to obtain the greatest liquid product flow from any given turboexpander. The refrigeration output of a turboexpander is dependent upon the expansion flow, pressure-expansion ratio and operating temperature.

In many instances, the only practical method of increasing the refrigeration output is by increasing the operating temperature at which the expansion occurs. However, there exists a limit to which this can be done particularly when the turbine exhausts directly into a column. As the turbine exhaust becomes superheated, its introduction into a distillation column will invariably result in the partial vaporization of down coming liquid. Packed columns are particularly susceptible to mal-performance from vapor feed superheating given the limited liquid holdup. A feed superheated by more than 10° C. can readily lead to excessive local column vapor loading which can lead to the measurable loss of observed staging and/or potential flooding.

A cryogenic rectification process and apparatus for separating air is disclosed in U.S. Pat. No. 6,000,239 in which the operational temperature of the turbine is increased and the superheating within the turbine exhaust is removed through indirect heat transfer. In this patent, the air after having been compressed and purified is divided into two streams. One of the two streams is fully cooled within the main heat exchanger and introduced into the higher pressure column. The other of the two streams is compressed within a booster compressor and then subdivided. A portion of the stream is fully cooled and condensed within the main heat exchanger. Another portion of the stream bypasses the main heat exchanger and is turboexpanded without entering the main heat exchanger. Due to the high inlet temperature, the exhaust stream is superheated and cannot be introduced directly into the distillation column. In this patent, an oxygen-rich liquid stream from the lower pressure column is pumped and then passed into a heat exchanger to indirectly exchange heat with the exhaust stream and thereby remove its superheated state. Thereafter, the oxygen-rich liquid stream is vaporized within the main heat exchanger together to produce a high pressure oxygen product.

In U.S. Pat. No. 6,000,239 an extremely high expansion ratio must be used to enable the exhaust to bypass cooling within the main heat exchanger. Such a turboexpander would be a highly specialized device exhibiting an isentropic expansion efficiency somewhat lower than those typically associated with a more conventional expansion ratio (~90%). However, since the expansion is conducted at elevated temperature, the turboexpander operates with increased refrigeration-work per unit of mass flow. This fact offsets lower isentropic efficiency and furthermore makes for a more compact process.

Relevant to this discussion is U.S. Pat. No. 3,355,901 that has as its objective the control of the degree of superheating within a turbine exhaust. However, the problem addressed in this patent is in some respects the reverse of the technological problem addressed in U.S. Pat. No. 6,000,239 and the present invention. In U.S. Pat. No. 3,355,901, it is intended to impart a slight degree of superheating to the turbine exhaust rather than removing the superheating from the exhaust. In this patent, a warm portion of a vapor stream to be cooled and introduced into a turboexpander is combined with the cooled vapor stream to ensure a slight degree of superheating in the turbine exhaust to prevent damage to the turbine. The degree of superheat is controlled by adjusting the flow of the cooled vapor stream and therefore, also, the warm portion thereof, to in turn control the temperature at the inlet of the turbine.

This control is effectuated by positioning a temperature sensitive bulb within a line leading to an air separation unit that contains a reference fluid having the same composition of turbine exhaust, for example, air. The bulb is pressurized to the saturation pressure of the reference fluid. The pressure difference between the bulb and pressure measurement taken within the line leading to the air separation unit are compared within a differential pressure transmitter to produce a signal referable to the saturation temperature of the turbine exhaust. In a cascade control scheme, a subsequent controller is used to correct the output signal from the differential pressure transmitter as required and the output of such controller is then sent to a further controller to control the setting of a flow control valve upstream of the turboexpander.

As will be discussed, the present invention provides a method and apparatus related to cryogenic distillation in which a turboexpander is utilized at high temperature to generate a superheated exhaust stream at more conventional expansion ratios to avoid the use of specialized and expensive equipment.

SUMMARY OF THE INVENTION

The present invention in one aspect relates to a distillation method. In accordance with such method a first compressed stream and a second compressed stream are formed from a compressed feed stream containing components to be separated.

The first compressed stream is discharged from a main heat exchanger such that the first compressed stream is fully cooled and is substantially condensed. The second compressed stream is also discharged from the main heat exchanger such that the second compressed stream is partially cooled. In this regard, as used herein and in the claims the term "fully cooled" means that a stream is cooled to a temperature existing at the cold end of the main heat exchanger. As used herein and in the claims, the term "partially cooled" means cooled to a temperature that is intermediate in the warm and cold ends of the main heat exchanger. Additionally, the term, "fully warmed" as used herein and in the claims means warmed to a temperature at the warm end of the main heat exchanger.

At least part of the second compressed stream is expanded in a turboexpander to produce an exhaust stream. The second compressed stream is partially cooled such that the exhaust stream is superheated. At least part of the exhaust stream is combined with at least part of the first compressed stream such that a combined stream is produced having a temperature that is no greater than about 10° C. of a saturation temperature. The combined stream is introduced into a cryogenic distillation process to produce at least one product stream enriched in one of the components of the feed stream. The at least one product stream is fully warmed within the main heat exchanger.

In applications of the invention in which the feed stream is obtained at pressure, for instance, in nitrogen reject units, the feed stream can be utilized without further compression. However, in other processes, for instance the cryogenic rectification of air, the feed stream is compressed in a compressor to form the compressed feed stream.

The components of the feed stream can comprise oxygen and nitrogen. The distillation process is conducted, at least in part, in a double column unit having a higher pressure column in a heat transfer relationship with the lower pressure column such that a nitrogen-rich column overhead of the higher pressure column is condensed against boiling an oxygen-rich liquid of the lower pressure column. The higher pressure column and the lower pressure column are connected such that a stream of a crude-liquid oxygen column bottoms of the higher pressure column is expanded and introduced into the lower pressure column. Additionally, streams of nitrogen-rich liquid produced from the condensation of the nitrogen-rich column overhead, at least in part, are used to reflux both the higher pressure column and the lower pressure column.

The at least one product stream can comprise an oxygen product stream composed of the oxygen-rich liquid column bottoms and a nitrogen product stream composed of nitrogen-rich vapor produced as column overhead in the lower pressure column.

The combined stream can be introduced into the higher pressure column. The first compressed stream can be divided into a first portion and a second portion. The first portion of the first compressed stream is combined with the exhaust stream and the second portion of the first compressed stream can be introduced into at least one of the higher pressure column or the lower pressure column.

The feed stream can be air and the compressed feed stream is purified of contaminants. As known in the art, such contaminants are water vapor, carbon dioxide and possibly hydrocarbons. A stream of the oxygen-rich liquid column bottoms can be pumped to form a pumped liquid oxygen stream. At least part of the pumped liquid oxygen stream forms the oxygen product stream and the oxygen product stream is vaporized within the main heat exchanger.

Part of the compressed feed stream can be further compressed, thereby to form the first compressed stream and the first compressed stream is thereafter introduced into the main heat exchanger. A remaining part of the compressed feed stream can be further compressed, thereby to form the second compressed stream. The second compressed stream is thereupon introduced into the main heat exchanger. The second portion of the first compressed stream is expanded and a first part thereof is introduced into the higher pressure column. A second part of the second portion of the first compressed stream is expanded and introduced into the lower pressure column.

One of the streams of the nitrogen-rich liquid can be subcooled and at least in part introduced into the lower pressure column as reflux. A waste nitrogen stream is withdrawn from the lower pressure column. The waste nitrogen stream and the nitrogen product stream are passed in indirect heat exchange with the one of the streams of the nitrogen-rich liquid, thereby to subcool the one of the streams of the nitrogen-rich liquid. The waste nitrogen stream and the nitrogen product stream are thereafter introduced into the main heat exchanger and the waste nitrogen stream fully warms within the main heat exchanger.

In another aspect, the present invention relates to a distillation apparatus. The distillation apparatus includes a main heat exchanger configured to discharge a first compressed stream such that the first compressed stream is fully cooled and is substantially condensed and to discharge a second compressed stream such that the second compressed stream is partially cooled. The first compressed stream and the second compressed stream are formed from a compressed feed stream containing components to be separated.

A turboexpander is connected to the main heat exchanger such that the at least part of the second compressed stream is expanded to produce an exhaust stream. The second compressed stream is discharged from a location of the main heat exchanger such that the exhaust stream is superheated.

A mixing device is connected to the main heat exchanger and the turboexpander such that at least part of the first compressed stream combines with the exhaust stream and a combined stream is formed having a temperature that is no greater than about 10° C. above the saturation temperature of the exhaust stream.

A distillation column unit is connected to the mixing device such that the combined stream is introduced into the distillation column unit. The distillation column unit is configured to produce at least one product stream enriched in one of the components of the feed stream. The main heat exchanger is also connected to the distillation column unit so that the at least one product stream fully warms within the main heat exchanger.

In case the feed stream is not supplied at elevated pressure, a compressor can be provided in flow communication with the main heat exchanger to compress a feed stream, thereby to form the compressed feed stream.

The components of the feed stream can comprise oxygen and nitrogen. The distillation column unit has a higher pressure column in a heat transfer relationship with the lower pressure column such that a nitrogen-rich column overhead of the higher pressure column is condensed against boiling an oxygen-rich liquid of the lower pressure column. The higher pressure column and the lower pressure column are connected such that a stream of a crude-liquid oxygen column bottoms of the higher pressure column is introduced into the lower pressure column. Streams of nitrogen-rich liquid produced from the condensation of the nitrogen-rich column overhead, at least in part, reflux, both the higher pressure column and the lower pressure column.

A first expansion valve is interposed between the higher pressure column and the lower pressure column to expand the steam of the crude-liquid oxygen column bottoms. The at least one product stream comprises an oxygen product stream composed of the oxygen-rich liquid column bottoms and a nitrogen product stream composed of nitrogen-rich vapor produced as column overhead in the lower pressure column.

The main heat exchanger is in flow communication with the lower pressure column and is configured such that the oxygen product stream and the nitrogen product stream fully warm within the main heat exchanger. The mixing device is connected to the higher pressure column so that the combined stream is introduced into the higher pressure column. The mixing device can also be connected to the main heat exchanger so that a first portion of the first compressed stream combines with the exhaust stream. The distillation column unit can be connected to the main heat exchanger so that at least part of the second portion of the first compressed stream is introduced into at least one of the higher pressure column or the lower pressure column.

A pump can be connected to the lower pressure column so that a stream of the oxygen-rich liquid column bottoms is pumped to form a pumped liquid oxygen stream. The main heat exchanger is in flow communication with the pump so that at least part of the pumped liquid oxygen stream forms the oxygen product stream and vaporizes within the main heat exchanger.

The compressor in such case that is utilized to compress the feed stream can be a first compressor. A second compressor can be connected to the purification unit so that part of the compressed feed stream is further compressed, thereby to form the first compressed stream. The main heat exchanger is connected to the second compressor so that the first compressed stream is introduced into the main heat exchanger. A first booster compressor is also connected to the purification unit so that a remaining part of the compressed feed stream is further compressed within the first booster compressor. A second booster compressor in flow communication with the first booster compressor is provided to yet further compress the remaining part of the compressed feed stream, thereby to form the second compressed stream. The second booster compressor is also connected to the main heat exchanger so that the second compressed stream is introduced into the main heat exchanger.

The mixing device can be connected to the higher pressure column so that the combined stream is introduced into the higher pressure column. An expansion device is connected between the mixing device and the main heat exchanger so that the first portion of the first compressed stream is reduced in pressure prior to combining with the at least part of the second compressed stream.

The higher pressure column and the lower pressure column are in flow communication with the main heat exchanger so that a first part of the second portion of the first compressed stream is introduced into the higher pressure column and a second part of the second portion of the first compressed stream is introduced into the lower pressure column. Second and third expansion valves are interposed between main heat exchanger and the higher pressure column and the lower pressure column, respectively, so that the first part and the second part of the second portion of the first compressed stream are reduced in pressure prior to entering the higher pressure column and the lower pressure column.

A subcooling unit can be connected to the distillation column unit so that one of the streams of the nitrogen-rich liquid is subcooled. The lower pressure column is connected to the subcooling unit so that the one of the streams of the nitrogen-rich liquid is at least in part introduced in the lower pressure column as reflux. The subcooling unit can be connected to the lower pressure column so that a waste nitrogen stream and the nitrogen product stream pass in indirect heat exchange with one of the streams of the nitrogen-rich liquid, thereby to subcool the one of the streams of the nitrogen-rich liquid. The main heat exchanger can be connected to the subcooling unit so that the waste nitrogen stream and the nitrogen product stream are introduced into the main heat exchanger and the waste nitrogen stream also fully warms within the main heat exchanger.

BRIEF DESCRIPTION OF THE DRAWING

While the specification concludes with claims distinctly pointing out the subject matter that Applicant regards as his invention, it is believed that the invention will be better understood when taken in connection with the accompanying sole FIGURE in which a process flow diagram of an apparatus is illustrated for use in carrying out a method in accordance with the present invention.

DETAILED DESCRIPTION

With reference to the FIGURE, a feed stream 10 containing components to be separated is introduced into an apparatus 1 to separate components contained within the feed stream. For purposes of illustration, the feed stream 10 comprises oxygen and nitrogen and can be an air stream composed of ambient air to separate components of the feed within apparatus 1 by cryogenic rectification. However, it is understood that the present invention has equal applicability to other distillation processes, for example, a nitrogen reject unit such as discussed above. As indicated below, the feed stream 10 is compressed. However, in other applications of the present invention such as a nitrogen reject unit, the feed stream 10 might be obtained at pressure and therefore need no further compression.

A further point is that although the present invention is illustrated in connection with an air separation plant, it would have applicability to any distillation process involving two or more compressed feed streams and one or more product streams that are used in cooling the compressed feed streams in a main heat exchanger. Moreover, the present invention is also applicable to systems in which some of the refrigeration is supplied by an external refrigeration source and/or additional refrigeration is supplied by turboexpanding a liquid process stream.

In the illustrated embodiment, feed stream 10 is compressed within a first compressor 12 to a pressure that can be between about 5 bar(a) and about 15 bar(a). Compressor 12 may be an intercooled, integral gear compressor with condensate removal that is not shown. After compression, the resultant compressed feed stream 14 is introduced into a prepurification unit 16. Prepurification unit 16 as well known in the art typically contains beds of alumina and/or molecular sieve operating in accordance with a temperature and/or pressure swing adsorption cycle in which moisture and other higher boiling impurities are adsorbed. As known in the art, such higher boiling impurities are typically, carbon dioxide, water vapor and hydrocarbons. While one bed is operating, another bed is regenerated. Other processes could be used such as direct contact water cooling, refrigeration based chilling, direct contact with chilled water and phase separation.

The resultant compressed and purified feed stream 18 is then divided into a stream 20 and a stream 22. Typically, stream 20 is between about 25 percent and about 35 percent of the compressed and purified feed stream 18 and as illustrated, the remainder is stream 22.

Stream 20 is then further compressed within a compressor 23 which again may comprise intercooled, integral gear compressor with condensate removal. The second compressor 23 compresses the stream 20 to a pressure that can be compressed between about 25 bar(a) and about 70 bar(a) to produce a first compressed stream 24. The first compressed stream 24 is thereafter introduced into a main heat exchanger 25 where it is substantially condensed at the cold end of main heat exchanger 25. In this regard, "substantially condensed" as used herein and in the claims means a liquid content of no less than about 95 percent.

Stream 22 is further compressed by a turbine loaded booster compressor 26. After removal of the heat of compression by preferably, an after cooler 28, such stream is yet further compressed by a second booster compressor 29 to a pressure that can be in the range from between about 20 bar(a) to about 60 bar(a) to produce a second compressed stream 30. Second compressed stream 30 is then introduced into main heat exchanger 25 in which it is partially cooled to a temperature in a range of between about 160 and about 220 Kelvin and is subsequently introduced into a turboexpander 32 to produce an exhaust stream 34.

As can be appreciated, the compression of stream 22 could take place in a single compression machine. As illustrated, turboexpander 32 is linked with first booster compressor 26, either directly or by appropriate gearing. However, it is also possible that turboexpander be connected to a generator to generate electricity that could be used on-site or routed to the grid. Furthermore, although main heat exchanger 25 is illustrated as a single device, main heat exchanger 25 could be a heat exchanger complex having a group of separate heat exchangers. For example, as well known in the art, main heat exchanger 25 could be banked heat exchangers employed to separately cool first compressed stream 24 and second compressed stream 30. Moreover, separate heat exchangers could be used at warm and cold ends of the heat exchange process. As such the term, "main heat exchanger" as used herein and in the claims means and encompasses a single heat exchanger or multiple heat exchangers.

A first portion 36 of the first compressed stream 24 is introduced into a flow control device 38 to reduce its pressure and as will be discussed to control its flow. First portion 36 of first compressed stream 24 is combined with exhaust stream 34 within a mixing device 40 to produce a combined stream 42 that is no greater than 10° C. and preferably between about 5° C. and about 10° C. of the saturation temperature at the exhaust pressure of the turboexpander 32. Combined stream 42 is then introduced into a distillation column unit 50 that will be discussed.

Flow control device 38 can have a constant setting to divert a fixed flow of the first portion 36 of the first compressed stream 24 and hence, simply be a piping tee with an appropriate expansion device such as a valve to reduce the pressure of first portion 36 of first compressed stream 24 to a level compatible with its combination into mixing device 40. However, it could be a variable flow device that was controlled to in turn control the degree of superheat within combined stream 42. Numerous known feed back control methods could be used for such purposes. For example, the same cascade control system used in U.S. Pat. No. 3,355,901 could be used to sense the degree of superheating within combined stream 42 and flow control device 38 would be adjusted to maintain the degree of superheating at a constant level.

It should be noted that flow control devices 38 and 45 may be valves and/or liquid expansion devices. In this way additional cold end refrigeration may be generated. As can be appreciated, embodiments of the present invention are possible in which only part of the second compressed stream 30, after having been partially cooled, is introduced into expander 32. Another part of the stream can be directed back into main heat exchanger 25 where it is further cooled and liquefied and fed to a distillation column unit 50 to be discussed. Similarly, not all of the exhaust stream 34 need be directed to the distillation column unit 50. A portion of the exhaust stream 34 can be recirculated back to the warm end of first compressor 12 or possibly second compressor 23. As indicated below, the present invention could be employed with introduction of a stream derived from a turboexpander exhausting into a lower pressure column. In such case a portion of the exhaust stream of the turboexpander can be directed to a waste stream or warmed directly and vented. Furthermore, although it is only a first portion 36 of first compressed stream 24 that is combined with exhaust stream 34, it is understood that in a particular distillation process all of the fully cooled stream, for example, first compressed stream 24 could be combined in its entirety with exhaust stream 34.

Mixing device 40 can be a simple vessel with a gas sparger or first compressed stream 24 may be introduced inline through a nozzle or similar device. In general, a static mixing device is typically an enlarged section of pipe with internal finning or baffling which facilitates contact of the liquid and vapor streams. It is to be noted that the second compressed stream 24 could be fed so that a portion of the stream is fully vaporized upon contact with exhaust stream 34. In such case a purge/excess liquid stream could be taken from the mixing device/vessel and directed to a suitable location within the distillation column unit 50.

A second portion 44 of the first compressed stream 24 after having been substantially condensed and cooled, is expanded in an expansion valve 45 into a liquid and divided into liquid streams 46 and 48 for eventual introduction into the distillation column unit 50.

The aforementioned components of the feed stream 10, oxygen and nitrogen, are separated within a distillation column unit 50 that consists of a higher pressure column 52 and a lower pressure column 54. It is understood that if argon were a necessary product, an argon column could be incorporated into the distillation column unit 50. Higher pressure column 52 operates at a higher pressure than lower pressure column 54. In this regard, lower pressure column 54 typically operates at between about 1.1 to about 1.5 bar(a).

The higher pressure column 52 and the lower pressure column 54 are in a heat transfer relationship such that a nitrogen-rich vapor column overhead extracted from the top of higher pressure column 52 as a stream 54 is condensed within a condenser-reboiler 56 located in the base of lower pressure column 54 against boiling an oxygen-rich liquid column bottoms 58. The boiling of oxygen-rich liquid column bottoms 58 initiates the formation of an ascending vapor phase within lower pressure column 54. The condensation produces a liquid nitrogen containing stream 60 that is divided into streams 62 and 64 that reflux the higher pressure column 52 and the lower pressure column 54, respectively to initiate the formation of descending liquid phases in such columns.

Combined stream 42 is introduced into the higher pressure column 52 along with the liquid stream 46. However, it is understood that the subject invention could be applied to other numerous process arrangements including those in which gaseous oxygen is produced directly from a lower pressure column of a double column unit also having a higher pressure column. In such an arrangement, a combined stream that is derived from an exhaust stream of a turboexpander could be supplied to the lower pressure column or an exhaust stream produced from high pressure nitrogen expansion. In the illustrated embodiment, these streams are rectified within higher pressure distillation column 52 by contacting an ascending vapor phase of such mixture within mass transfer contacting elements 66 and 68 with a descending liquid phase that is initiated by reflux stream 62. This produces a crude-liquid oxygen column bottoms 70 and the nitrogen-rich column overhead that has been previously discussed. A stream 72 of the crude-liquid oxygen column bottoms is expanded in an expansion valve 74 to the pressure of the lower pressure column 54 and introduced into such column for further refinement along with the second liquid stream 48. Second liquid stream 48 is passed through an expansion valve 76 and expanded to the pressure of lower pressure column 54.

Lower pressure column 54 is provided with mass transfer contacting elements 78, 80, 82 and 84 that can be trays or structured packing or random packing or other known elements in the art. As stated previously, the separation produces an oxygen-rich liquid column bottoms 58 and a nitrogen-rich vapor column overhead that is extracted as a nitrogen product stream 86. Additionally, a waste stream 88 is also extracted to control the purity of nitrogen product stream 86. Both nitrogen product stream 86 and waste stream 88 are passed through a subcooling unit 90. Subcooling unit 90 subcools reflux stream 64. Part of reflux stream 64 as a stream 92 may optionally be taken as a liquid product and a remaining part 93 may be introduced into lower pressure column 54.

After passage through subcooling unit 90, nitrogen product stream 86 and waste stream 88 are fully warmed within main heat exchanger 25 to produce the warmed nitrogen product stream 94 and a warmed waste stream 95. Warmed waste stream 95 may be used to regenerate the adsorbents within prepurification unit 16. In addition, an oxygen-rich liquid stream 96 is extracted from the bottom of the lower pressure column 80 that consists of the oxygen-rich liquid column bottoms 58. Oxygen-rich liquid stream 96 can be pumped by a pump 98 to form a pressurized oxygen containing stream 100. Part of the pressurized liquid oxygen stream 100 can optionally be taken as a liquid oxygen product stream 102. The remainder 104 can be fully warmed in main heat exchanger 25 and vaporized to produce an oxygen product stream 106 at pressure.

While the present invention has been described in reference to a preferred embodiment as will occur to those skilled in the art, numerous changes and additions and omissions can be made without departing from the spirit and the scope of the present invention as set forth in the appended claims.

I claim:

1. A distillation method comprising:

forming a first compressed stream and a second compressed stream from a compressed feed stream containing components to be separated;

discharging the first compressed stream from a main heat exchanger such that the first compressed stream is fully cooled and is substantially condensed;

discharging the second compressed stream from a main heat exchanger such that the second compressed stream is partially cooled;

expanding at least part of the second compressed stream in a turboexpander to produce an exhaust stream, the second compressed stream being partially cooled such that the exhaust stream is superheated;

combining at least part of the exhaust stream with at least part of the first compressed stream after the first compressed stream has been fully cooled and substantially condensed such that a combined stream is produced having a temperature that is no greater than about 10° C. of a saturation temperature of the exhaust stream;

introducing the combined stream into a cryogenic distillation process configured to separate the components in the compressed feed stream and to produce at least one product stream enriched in one of the components of a feed stream; and fully warming the at least one product stream within the main heat exchanger;

the components of the feed stream comprise oxygen and nitrogen;

the distillation process is conducted, at least in part, in a double column unit having a higher pressure column in a heat transfer relationship with a lower pressure column such that a nitrogen-rich column overhead of the higher pressure column is condensed against boiling an oxygen-rich liquid of the lower pressure column;

the higher pressure column and the lower pressure column being connected such that a stream of a crude-liquid oxygen column bottoms of the higher pressure column is expanded and introduced into the lower pressure column, streams of nitrogen-rich liquid produced from the condensation of the nitrogen-rich column overhead, at least in part, reflux both the higher pressure column and the lower pressure column;

the at least one product stream comprises an oxygen product stream composed of the oxygen-rich liquid column bottoms and a nitrogen product stream composed of nitrogen-rich vapor produced as column overhead in the lower pressure column;

the combined stream is introduced into the higher pressure column;

the first compressed stream is divided into a first portion and a second portion;

the first portion of the first compressed stream is combined with the exhaust stream; and the second portion of the first compressed stream is introduced into at least one of the higher pressure column or the lower pressure column.

2. The method of claim 1, further comprising compressing the feed stream in a compressor to form the compressed feed stream.

3. The method of claim 2, wherein:

the feed stream is air and the compressed feed stream is purified of contaminants;

a stream of the oxygen-rich liquid column bottoms is pumped to form a pumped liquid oxygen stream, at least part of the pumped liquid oxygen stream forms the oxygen product stream and the oxygen product stream is vaporized within the main heat exchanger;

part of compressed feed stream is further compressed, thereby to form the first compressed stream and the first compressed stream is introduced into the main heat exchanger;

a remaining part of the compressed feed stream is further compressed to form the second compressed stream and the second compressed stream is introduced into the main heat exchanger; and the second portion of the first compressed stream is expanded, a first part of second portion of the first compressed stream is introduced into the higher pressure column and a second part of the second portion of the first compressed stream is expanded and introduced into the lower pressure column.

4. The method of claim 3, wherein:

one of the streams of the nitrogen-rich liquid is subcooled and is at least in part introduced into the lower pressure column as the reflux;

a waste nitrogen stream is withdrawn from the lower pressure column;

the waste nitrogen stream and the nitrogen product stream are passed in indirect heat exchange with the one of the streams of the nitrogen-rich liquid, thereby to subcool the one of the streams of the nitrogen-rich liquid;

the waste nitrogen stream and the nitrogen product stream are introduced into the main heat exchanger; and the waste nitrogen stream fully warms within the main heat exchanger.

5. A distillation apparatus comprising:

a main heat exchanger configured to discharge a first compressed stream such that the first compressed stream is fully cooled and is substantially condensed and to discharge a second compressed stream such that the second compressed stream is partially cooled;

the first compressed stream and the second compressed stream formed from a compressed feed stream containing components to be separated;

a turboexpander connected to the main heat exchanger such that at least part of the second compressed stream is expanded to produce an exhaust stream;

the second compressed feed discharged from a location of the main heat exchanger such that the exhaust stream is superheated;

a mixing device connected to the main heat exchanger and the turboexpander such that at least part of the first compressed stream, after having been fully cooled and substantially condensed, combines with the exhaust stream and a combined stream is formed having a temperature that is no greater than about 10° C. of a saturation temperature of the exhaust stream;

a distillation column unit connected to the mixing device such that the combined stream is introduced into the distillation column unit, the distillation column unit configured to produce at least one product stream enriched in one of the components of the compressed feed stream; and the main heat exchanger also connected to the distillation column unit so that the at least one product stream fully warms within the main heat exchanger;

the components of the compressed feed stream comprise oxygen and nitrogen;

the distillation column unit has a higher pressure column in a heat transfer relationship with a lower pressure column such that a nitrogen-rich column overhead of the higher pressure column is condensed against boiling an oxygen-rich liquid of the lower pressure column;

the higher pressure column and the lower pressure column are connected such that a stream of a crude-liquid oxygen column bottoms of the higher pressure column is introduced into the lower pressure column, streams of nitrogen-rich liquid produced from the condensation of the nitrogen-rich column overhead, at least in part, reflux both the higher pressure column and the lower pressure column;

a first expansion valve interposed between the higher pressure column and the lower pressure column to expand the stream of the crude-liquid oxygen column bottoms;

the at least one product stream comprises an oxygen product stream composed of the oxygen-rich liquid column bottoms and a nitrogen product stream composed of nitrogen-rich vapor produced as column overhead in the lower pressure column;

the main heat exchanger is in flow communication with the lower pressure column and configured such that the oxygen product stream and the nitrogen product stream fully warm within the main heat exchanger;

the mixing device is connected to the higher pressure column so that the combined stream is introduced into the higher pressure column;

the mixing device is connected to the main heat exchanger so that a first portion of the first compressed stream combines with the exhaust stream; and the distillation column unit is connected to the main heat exchanger so that the second portion of the first compressed stream is introduced into at least one of the higher pressure column or the lower pressure column.

6. The distillation apparatus of claim 5, wherein a compressor is in flow communication with the main heat exchanger to compress a feed stream, thereby to form the compressed feed stream.

7. The method of claim 6, wherein:

a pump is connected to the lower pressure column so that a stream of the oxygen-rich liquid column bottoms is pumped to form a pumped liquid oxygen stream;

the main heat exchanger is in flow communication with the pump so that at least part of the pumped liquid oxygen stream forms the oxygen product stream and vaporizes within the main heat exchanger;

the compressor is a first compressor;

a second compressor is connected to the purification unit so that part of the compressed feed stream is further compressed, thereby to form the first compressed stream; the main heat exchanger is connected to the second compressor so that the first compressed stream is introduced into the main heat exchanger;

a first booster compressor is also connected to the purification unit so that a remaining part of the compressed feed stream is further compressed within the first booster compressor;

a second booster compressor is in flow communication with the first booster compressor to yet further compress the remaining part of the compressed feed stream, thereby to form the second compressed stream, the second booster compressor is connected also to the main heat exchanger so that the second compressed stream is introduced into the main heat exchanger;

the mixing device connected to the higher pressure column so that the combined stream is introduced into the higher pressure column; and an expansion device connected between the mixing device and the main heat exchanger so that the first portion of the first compressed stream is reduced in pressure prior to combining with the at least part of the second compressed stream;

the higher pressure column and the lower pressure column in flow communication with the main heat exchanger so that a first part of the second portion of the first compressed stream is introduced into the higher pressure column and a second part of the second portion of the first compressed stream is introduced into the lower pressure column; and second and third expansion valves are interposed between the main heat exchanger and the higher pressure column and the lower pressure column, respectively, so that the first part and the second part of the second portion of the first compressed stream are reduced in pressure prior to entering the higher pressure column and the lower pressure column.

8. The method of claim 7, wherein:

a subcooling unit is connected to the distillation column unit so that one of the streams of the nitrogen-rich liquid is subcooled;

the lower pressure column is connected to the subcooling unit so that the one of the streams of the nitrogen-rich liquid is at least in part introduced into the lower pressure column as the reflux;

the subcooling unit is connected to the lower pressure column so that a waste nitrogen stream mad the nitrogen product stream pass in indirect heat exchange with the one of the streams of the nitrogen-rich liquid, thereby to subcool the one of the streams of the nitrogen-rich liquid; and the main heat exchanger is connected to the subcooling unit so that the waste nitrogen stream and the nitrogen product stream are introduced into the main heat exchanger and the waste nitrogen stream also fully warms within the main heat exchanger.

* * * * *